US006129182A

United States Patent [19]

Nakamura

[11] Patent Number: 6,129,182

[45] Date of Patent: Oct. 10, 2000

[54] HALL CONTROLLER PARAMETER-SETTING DEVICE

[75] Inventor: Kuniko Nakamura, Tokyo, Japan

[73] Assignee: Kabushiki Kaisha Toshiba, Kawasaki, Japan

[21] Appl. No.: 09/031,552

[22] Filed: Feb. 27, 1998

[30] Foreign Application Priority Data

Feb. 28, 1997 [JP] Japan ..... 9-060186

[51] Int. Cl.[7] ..... B66B 1/34; B66B 13/20

[52] U.S. Cl. ..... 187/391; 187/902; 187/380

[58] Field of Search ..... 187/391, 393, 187/902, 380; 702/85

[56] References Cited

U.S. PATENT DOCUMENTS 4,993,518 2/1991 van Staaten et al. ..... 187/902

*Primary Examiner*—Walter E. Snow

*Attorney, Agent, or Firm*—Oblon, Spivak, McClelland, Maier & Neustadt, P.C.

[57] ABSTRACT

When a reference cage is designated at the time of determining the parameters which distinguish hall devices, reference cage determination device 1 determines as the reference cage the designated cage out of upper and lower cages, and the reference cage determined by the reference cage determination device is raised/lowered to and stopped at a designated terminal floor by reference cage travel device 2. Then, parameter determination device 3 determines parameters based on the floor at which the reference cage determined by reference cage determination device 1 has stopped, and parameter transmission device 4 transmits the parameters determined by parameter determination device 3 to the hall device of the floor at which the reference cage is positioned.

By so doing, the setting of hall device parameters can be readily performed at the time of installation or the time of maintenance/replacement of double-deck elevators which do not possess projecting floors.

6 Claims, 12 Drawing Sheets

HALL CONTROLLER PARAMETER-SETTING DEVICE

BACKGROUND OF THE INVENTION

1. Field of the Invention

The present invention relates to a hall controller parameter-setting device for setting parameters in a hall device when installing or maintaining/replacing a double-decker elevator.

2. Description of the Related Art

With recent elevators, controllers having microcomputers are installed in various locations such as the machinery room, the cage and the halls, and the elevator is controlled by allotting the management of each while exchanging the required data by serial transmission. For example, the response to a call from a hall is executed as follows. When the hall call button of a hall device, which hall devices are installed at the halls on every floor, is pressed by a user, the elevator control equipment which is installed in the machinery room receives this signal and exercises control so that it causes the cage to move to that floor.

Hall devices are installed only to the number of the service floors. Therefore, for transmission between the elevator control equipment and the hall device, the elevator control equipment functions as the parent and is often constructed with a so-called party line connection method in which the multiple hall devices become the children. In the case of such a construction, the design is such that errors such as data conflicts are avoided by the various hall devices which are on the same transmission line having respective unique distinguishing numbers, that is to say device addresses.

Here, with an elevator, hall devices are respectively installed at each hall of a building, and the setting of the device addresses for the hall devices of each floor is performed afterwards. FIG. 1 is an illustration of the device address setting method for the hall devices with a single-deck elevator.

Elevator cage 12 moves to each floor by being connected to counterweight 13 by main rope 14. Then, when setting the device addresses of halls 9 on each floor, an operator rides in cage 12 and moves to each floor. For example, when cage 12 has reached the floor level for a certain floor (for example, the 5th floor) elevator control equipment 8 transmits the device address corresponding to that floor on transmission line 15.

In this state, the operator gets out at the hall (5th floor) and presses hall call button 11 of hall device 9. When this is done, that hall device 9 inputs from transmission line 15 via transmission interface 10 the device address which elevator control equipment 8 is transmitting at that time as its own 25 particular device address. The operator once more boards cage 12 and moves to the next floor. By repeating this process, the device addresses of hall devices 9 of all floors are set.

However, with double-decker elevators (or double-deck elevators) in which two cages are connected one above the other, the setting of the device address in hall device 9 sometimes cannot adequately be performed. That is to say, although the device address which the elevator control equipment outputs is a value corresponding to the cage position, in the case of a double-deck elevator there are two, upper and lower, cages. Therefore there is a requirement to produce a reference floor for setting the device address of one or other of the cages.

The double deck elevator has a construction in which two cages are connected vertically. With a normal elevator shaft space, the lower cage cannot reach the highest floor, nor the upper cage the lowest floor. If such floors are regarded as "unreachable floors", when the upper cage is taken as the reference, it is not possible to set a device address for the lowest floor (the unreachable floor), and when the lower cage is taken as the reference, it is not possible to set a device address for the highest floor (the unreachable floor).

Therefore, in order to solve the problem of such unreachable floors, it is desirable to design for the lower cage to be able to reach the highest floor by making the overhead part of the elevator shaft taller and for the upper cage to be able to reach the lowest floor by making the elevator shaft pit deeper, respectively. Hereafter such spaces are called "projecting floors".

However, there are many cases in which it is difficult to create projecting floors due to reduction of the design freedom of buildings, such as problems with infringement of rights to enjoy sunlight, and external appearance; major minus factors such as increase of building cost, and also, in such cases as at the time of replacement work for superannuated elevators (modernization). Thus it is not always possible to provide projecting floors for all double-deck elevators.

In this way, there was the problem that, with double-deck elevators which did not possess projecting floors, it was not possible to set the device addresses of reference cage unreachable floors.

SUMMARY OF THE INVENTION

Accordingly, one object of the present invention is to provide a novel hall controller parameter-setting device which can readily perform the setting of parameters which include the device addresses of hall devices when installing or maintaining/replacing double-deck elevators which do not possess projecting floors.

The above object of the present invention can be achieved by a hall controller parameter-setting device which satisfies the following structural requirements.

That is to say, in a hall controller parameter-setting device for setting parameters in hall devices installed at the halls on each floor for a double-deck elevator having a construction in which two cages are connected vertically, a reference cage determination device is provided which determines as the reference cage that cage out of the upper and lower cages which has been designated when the reference cage is designated at the time of determining the parameters which distinguish the hall devices. Also, a reference cage travel device is provided which raises/lowers the reference cage, which has been determined by the reference cage determination device, to and stops it at a designated terminal floor. Moreover, a parameter-determination device is provided which determines parameters based on the floor at which the reference cage determined by the reference cage determination device has stopped. Furthermore, a parameter transmission device is provided which transmits the parameters determined by the parameter determination device to the hall device of the floor at which the reference cage is located.

With the hall controller parameter-setting device concerned in the present invention, when the reference cage is designated at the time of determining the parameters which distinguish the hall devices, the reference cage determination device determines as the reference cage that cage which is designated out of the upper and lower cages, and the reference cage determined by the reference cage determination device is raised/lowered to and stopped at a designated terminal floor by the reference cage travel device. Then, the parameter determination device determines the parameters based on the floor at which the reference cage determined by the reference cage determination device has stopped, and the parameter transmission device transmits the parameters determined by the parameter determination device to the hall device on the floor at which the reference cage is positioned.

The above object of the present invention can be achieved by a hall controller parameter-setting device which satisfies the following structural requirements.

That is to say, in the above invention, a reference cage changing device is additionally provided which changes the reference cage to the other cage of the upper and lower cages.

With the hall controller parameter-setting device concerned in the present invention, in addition to the operation of the above invention, the reference cage changing device changes the reference cage to the other cage of the upper and lower cages for the reference cage unreachable floors.

The above-mentioned object of the present invention can be achieved by a hall controller parameter-setting device which satisfies the following structural requirements.

That is to say, in the above-mentioned invention, a fixed parameter transmission device is additionally provided for transmitting pre-determined parameters for the hall devices installed on specific floors out of the various floors.

With the hall controller parameter-setting device of the present invention, in addition to the operation of the above-mentioned invention, the fixed parameter transmission device transmits pre-determined parameters for the hall devices installed on specific floors which are unreachable by, for example, the upper cage or the lower cage, out of the various floors.

The above-mentioned object of the present invention can be achieved by a hall controller parameter-setting device which satisfies the following structural requirements.

That is to say, in the above-mentioned invention, a reference elevator changing device is additionally provided which changes the reference cage to the cage of another double-deck elevator which performs mutual data-exchange.

With the hall controller parameter-setting device concerned in the present invention, in addition to the operation of the above-mentioned invention, the reference elevator changing controller changes the reference cage to the cage of another double-deck elevator which performs mutual data-exchange.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
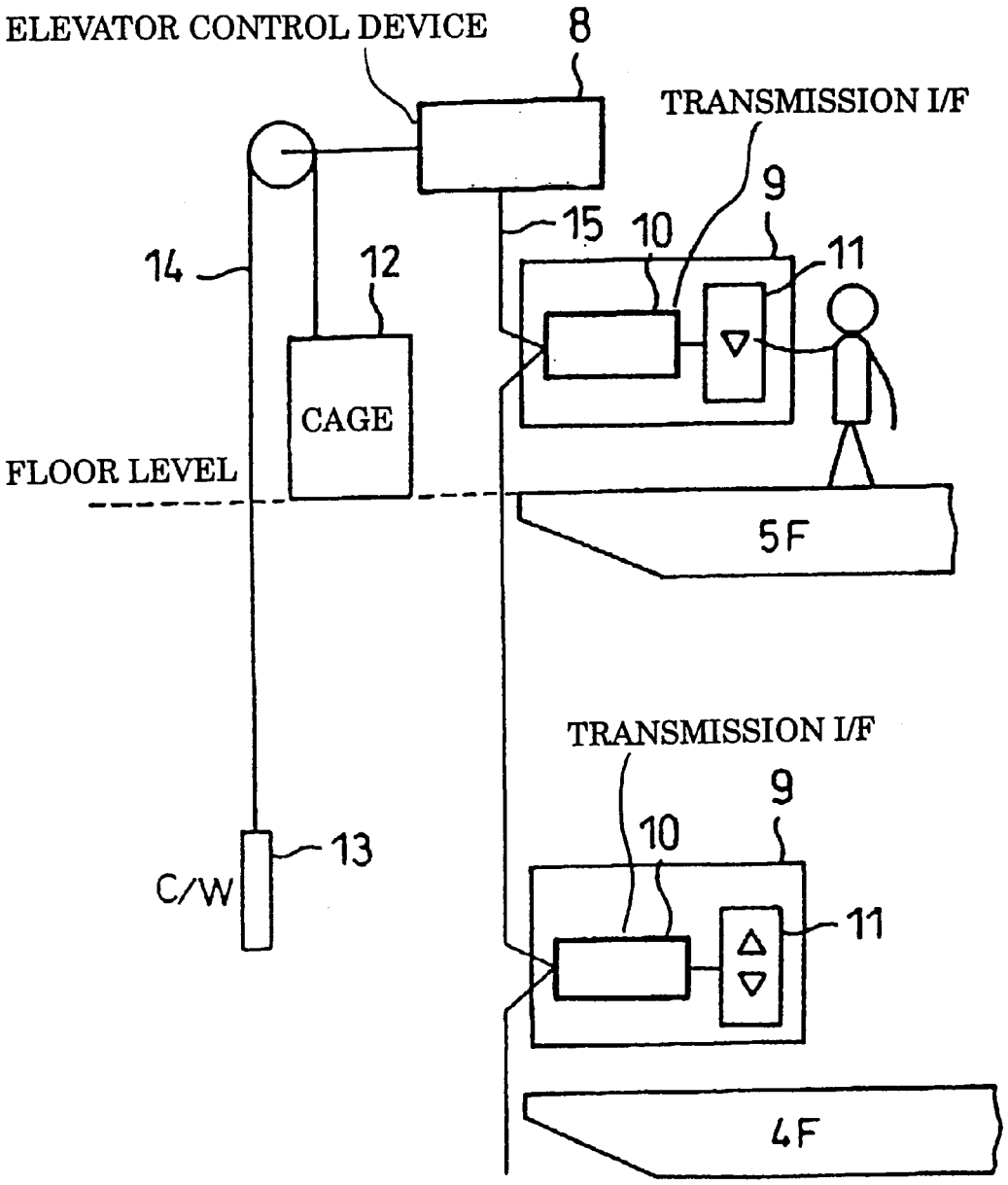
FIG. 1 ( PRIOR ART )
FIG. 1 is an illustration of the controller address setting method for the halls in a prior art double-deck elevator.

Referring now to the drawings, wherein like reference numerals designate identical or corresponding parts throughout the several views, and more particularly to FIG. 2 thereof, one embodiment of the present invention will be described.

Figure 2:
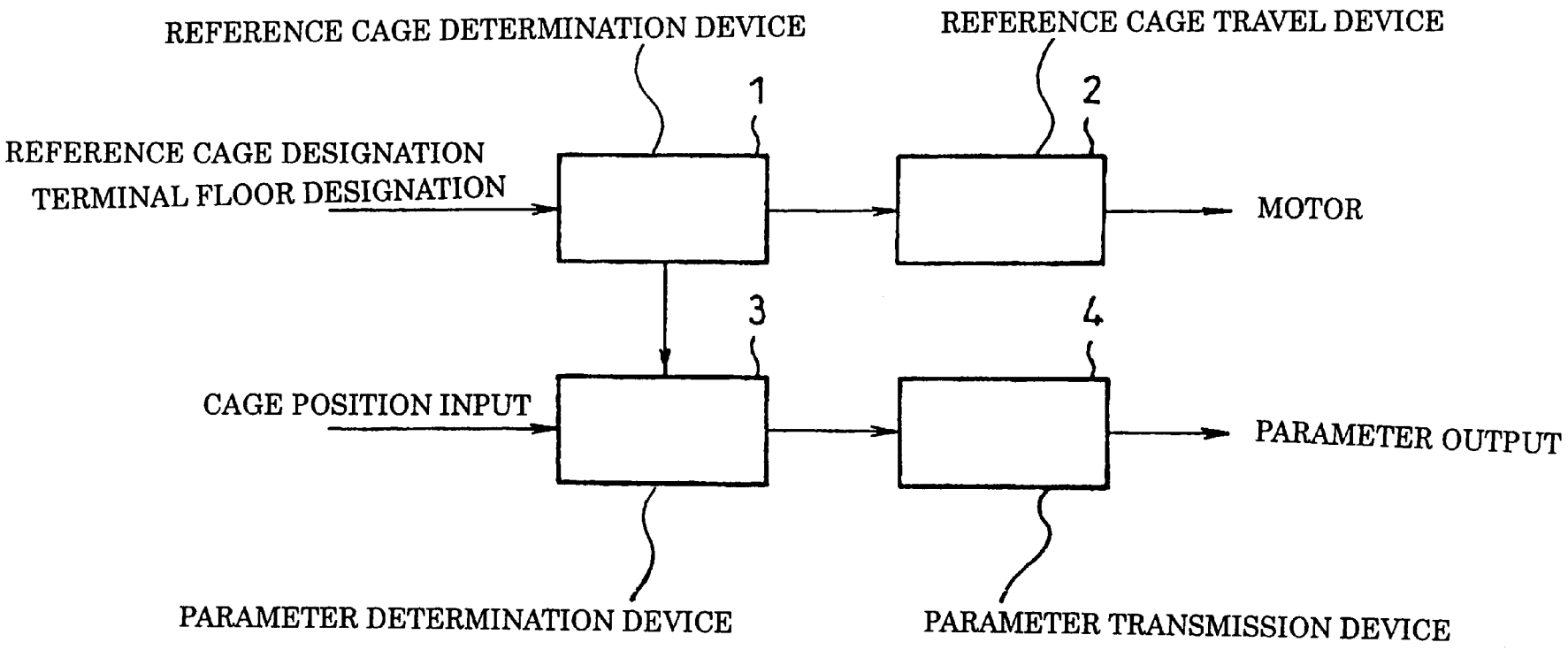
FIG. 2 is a block diagram of the hall controller parameter-setting device concerned in a first embodiment of the present invention.

FIG. 2 is a block diagram of the hall controller parameter-setting device concerned in a first embodiment of the present invention.

The hall controller parameter-setting device the present invention is provided within the elevator control controller. First, an operator inputs reference cage designation data and reference cage terminal floor designation data to reference cage determination controller 1 from an input device (not illustrated), for example a control desk connected to the elevator control device. Reference cage determination device 1 decides which of the upper and lower cages of the double-deck elevator has been selected as the reference cage based on the inputted reference cage designation data. Then, it outputs the reference cage data and the terminal floor data determined by reference cage determination controller 1 to reference cage travel device 2.

Reference cage travel device 2 is a controller which raises/lowers the reference cage determined by reference cage determination device 1 to and stops it at the designated terminal floor, and it raises/lowers the reference cage to the designated terminal floor by outputting drive commands to the motor.

At the same time, parameter determination device 3 inputs the reference cage data determined by reference cage determination device 1 and, when the reference cage has been raised/lowered to the designated terminal floor, determines the parameters of that floor. Then it transmits those determined parameters via parameter transmission device 4 to the hall device of the floor at which the reference cage is positioned. By this means, the prescribed parameters are set in the hall controller of that floor.

Figure 3:
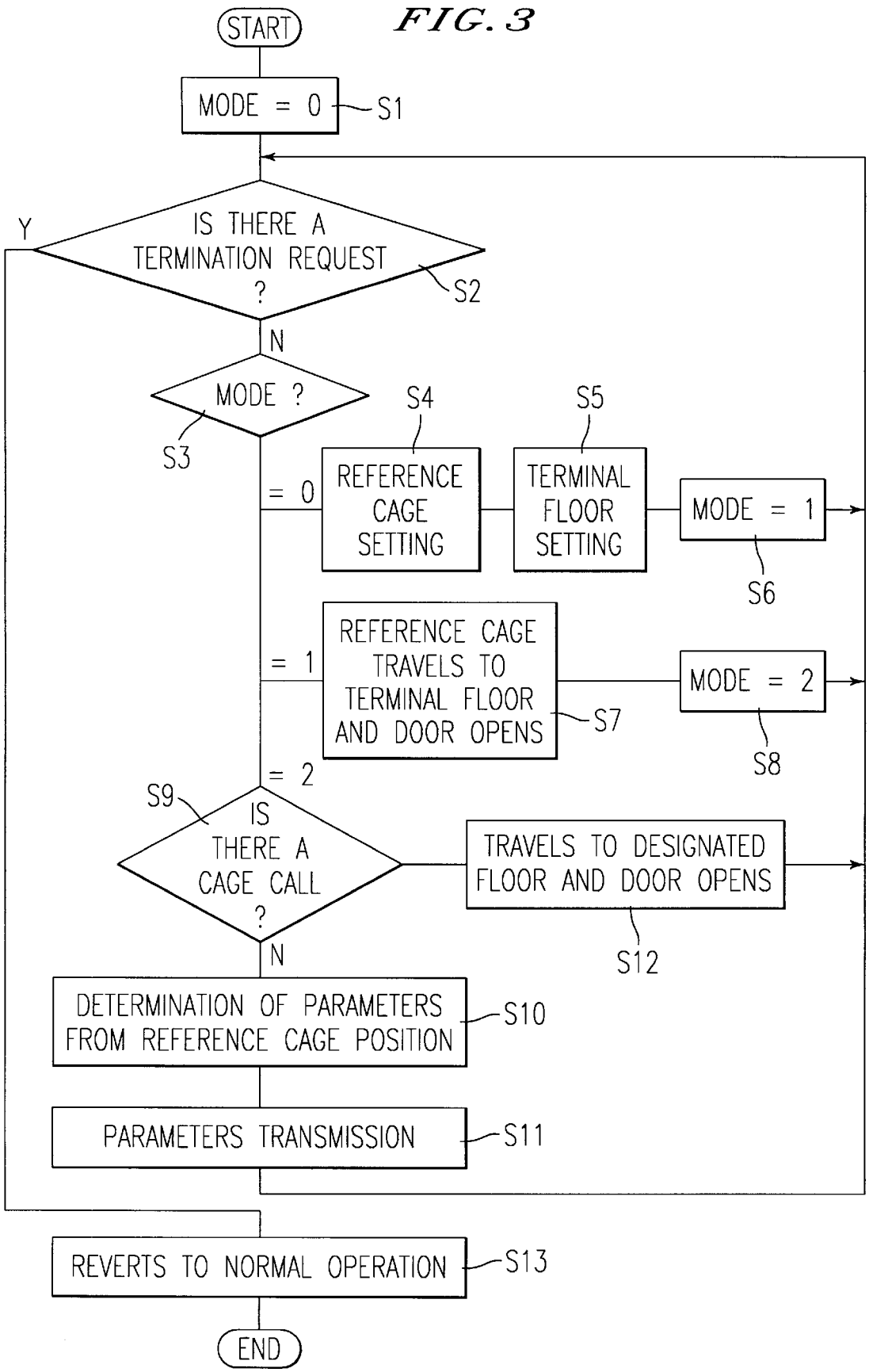
FIG. 3 is a flow-chart showing the operation of the hall controller parameter-setting device in the first embodiment.

FIG. 3 is a flow-chart showing the operation of the hall controller parameter-setting device in the first embodiment. First, in the initial state, the mode is "0" (S1). Then, whether or not there is a request to terminate processing is judged (S2). In the case of there not being a request to terminate processing, mode judgement is performed (S3). Since, when started in the initial state, the mode is "0", that cage designated out of the upper and lower cages based on the reference cage designation data inputted from the input controller by the operator is set as the reference cage (S4). In the same way, based on the terminal floor designation data which the operator has inputted, the reference cage terminal floor is set (S5). Then the mode is made "1" and the process returns to Step S2 (S6).

In Step S2, whether or not there is a request to terminate processing is judged, and judgement of the mode is performed in Step S3. In this case, since the mode has become "1", the reference cage is caused to travel to the terminal floor, is stopped at that terminal floor, and the door is opened (S7). Then the mode is made "2" and the process returns to Step S2 (S8). For example, in the case of the reference cage set in Step S4 being the upper cage and the terminal floor set in Step 5 being the 5th floor, the upper cage is caused to travel to the 5th floor, which is the terminal floor, it is stopped at the 5th floor, and the door is opened. At this time, of course, the lower cage is positioned at the 4th floor.

Moreover, next, whether or not there is a request to end processing is judged in Step S2, and judgement of the mode is performed in Step S3. In this case, since the mode has become "2", whether or not there is a cage call is judged by Step S9. In the case of there not being a cage call, the parameters corresponding to the cage position of the reference cage are determined (S10). Then, the parameters determined in Step S10 are transmitted to all the hall controllers installed on every floor, and the process returns to Step S2 (S11).

At the stage of Step S11, the action of the operator is to go to the terminal floor and press the hall call button on that floor. In other words, the hall device which has been given a parameter reception trigger (for example, pressing the hall call button) receives the transmitted parameters and thereafter holds them in the hall device memory as the parameters peculiar to that hall controller. By this means, the hall device receives the parameters corresponding to its floor and stores them in its memory.

Next, when the cage call button is pressed by an operator riding in the cage, the cage travels to the designated floor in the same way as with normal operation (S12). The operator moves to the target floor together with the cage and, by sequentially repeating Step S10 to Step S12, the hall device parameters of all the floors which the reference cage can reach can be set. For example, in the case of the terminal floor with the upper cage as the reference cage being made the highest floor, the hall device parameters can be set from the highest floor to one floor above the lowest floor.

In the case of a setting operation termination request being inputted by the operator during the operations from Step S4 to Step S12 (for instance, if the door opening button inside the reference cage is continuously pressed for 1 second or more), the elevator reverts to normal operation (S13). In other words, if hall device parameter setting has been completed as far as the final floor which the reference cage can reach (for instance, when the reference cage is the upper cage, the floor which is one floor above the lowest floor) by sequentially repeating Step S10 to Step S12, the operator inputs the termination request shown in Step S13 and the elevator at once reverts to normal operation.

After that, the operation from Step S1 is performed once more, designating as the reference cage a cage other than the cage designated as the reference cage on the previous occasion. For example, if it is taken that on the previous occasion the upper cage was taken as the reference cage and hall device parameter setting was performed as far as the floor which was one floor above the lowest floor, the new reference cage is taken as the lower cage. After Step S1 to Step S12 have been executed once more, in Step S12 the operator presses the cage call button on the lowest floor, and the reference cage is caused to travel to the floor which could not be set on the previous occasion (that is to say, the reference cage unreachable floor on the previous occasion). Then hall device parameter setting for that floor is performed. When the above is done, parameter-setting of hall devices installed on unreachable floors can be performed.

Figure 4:
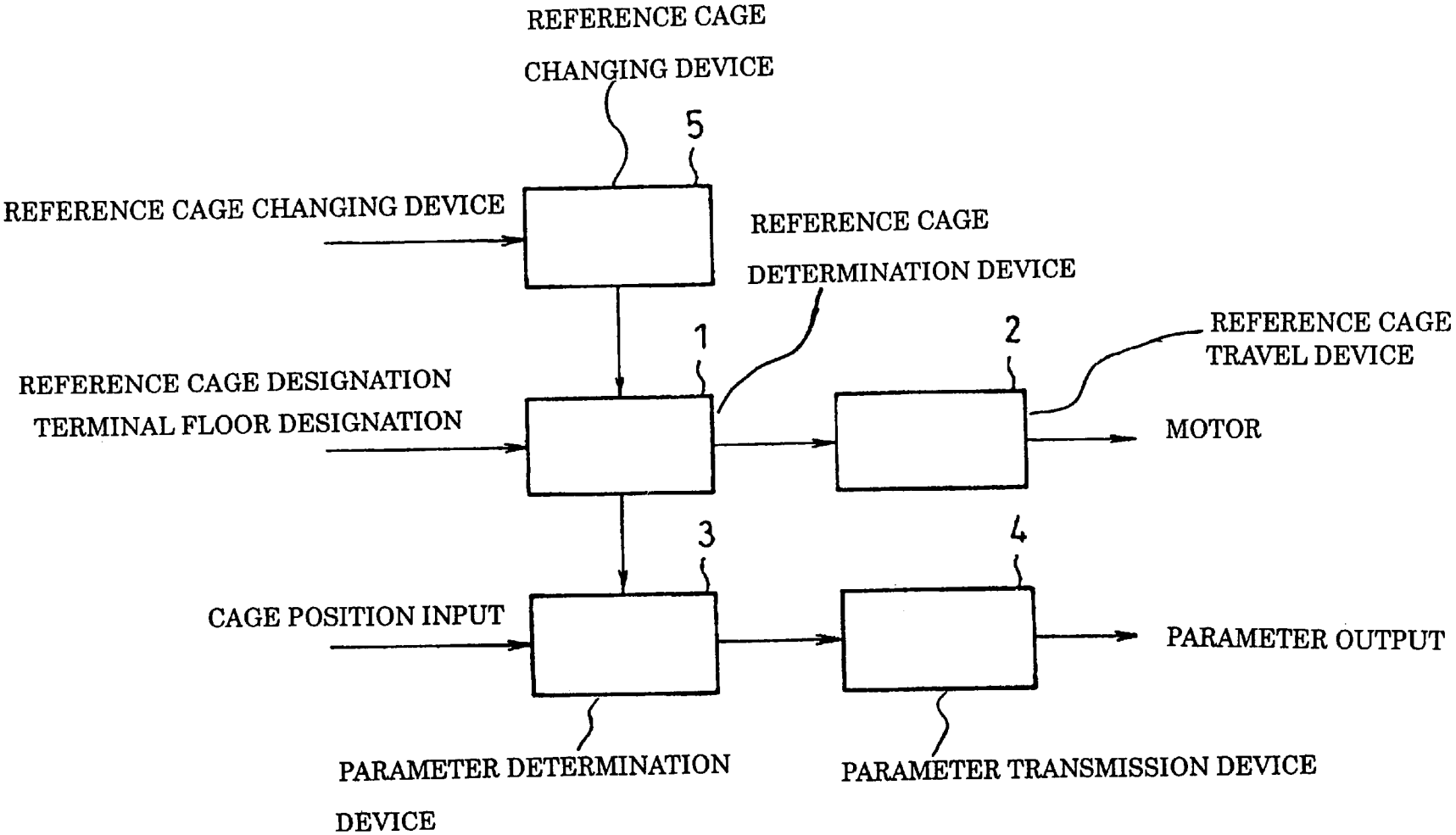
FIG. 4 is a block diagram of the hall controller parameter-setting device concerned in a second embodiment of the present invention.

Next, a second embodiment of the present invention is described. FIG. 4 is a block diagram of the hall controller parameter-setting device concerned in the second embodiment of the present invention. This second embodiment additionally provides reference cage changing device 5, which changes the reference cage to the other cage out of the upper and lower cages, to the first embodiment shown in FIG. 2. Since the rest of the composition is identical to that of the first embodiment shown in FIG. 2 and the same reference numerals designate identical parts, their descriptions have been omitted.

In FIG. 4, for setting the parameters of the hall devices of the reference cage unreachable floors, for example the lowest floor when the reference cage is the upper cage and the highest floor when the reference cage is the lower cage, the operator makes a reference cage change request. This reference cage change request is made by, for example simultaneously pressing the door closing button and the door opening button inside the reference cage.

When there is a reference cage change request, reference cage changing device 5 informs reference cage determination device 1 to that effect and re-sets the terminal floor. That is to say, if there is a reference cage change request, reference cage changing device closes the door after a prescribed time (for example 3 seconds). At that time the operator leaves the cage and waits at the hall. The cage position of the previous reference cage (the floor on which the operator is waiting) is set to the terminal floor, and the reference cage is changed to the other cage.

Figure 5A:
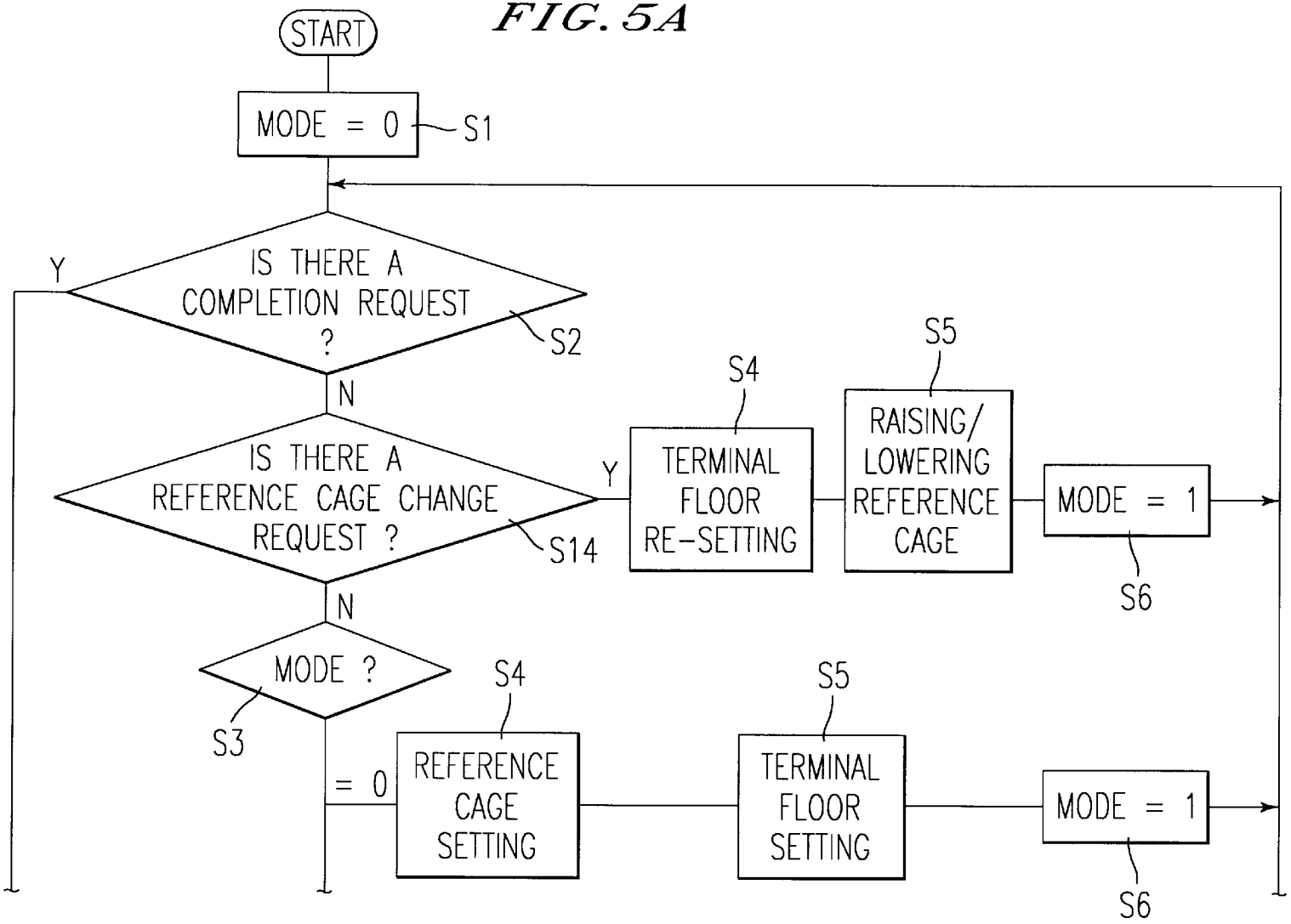
FIG. 5 is a flow-chart showing the operation of the hall controller parameter-setting device in the second embodiment.
Figure 5B:
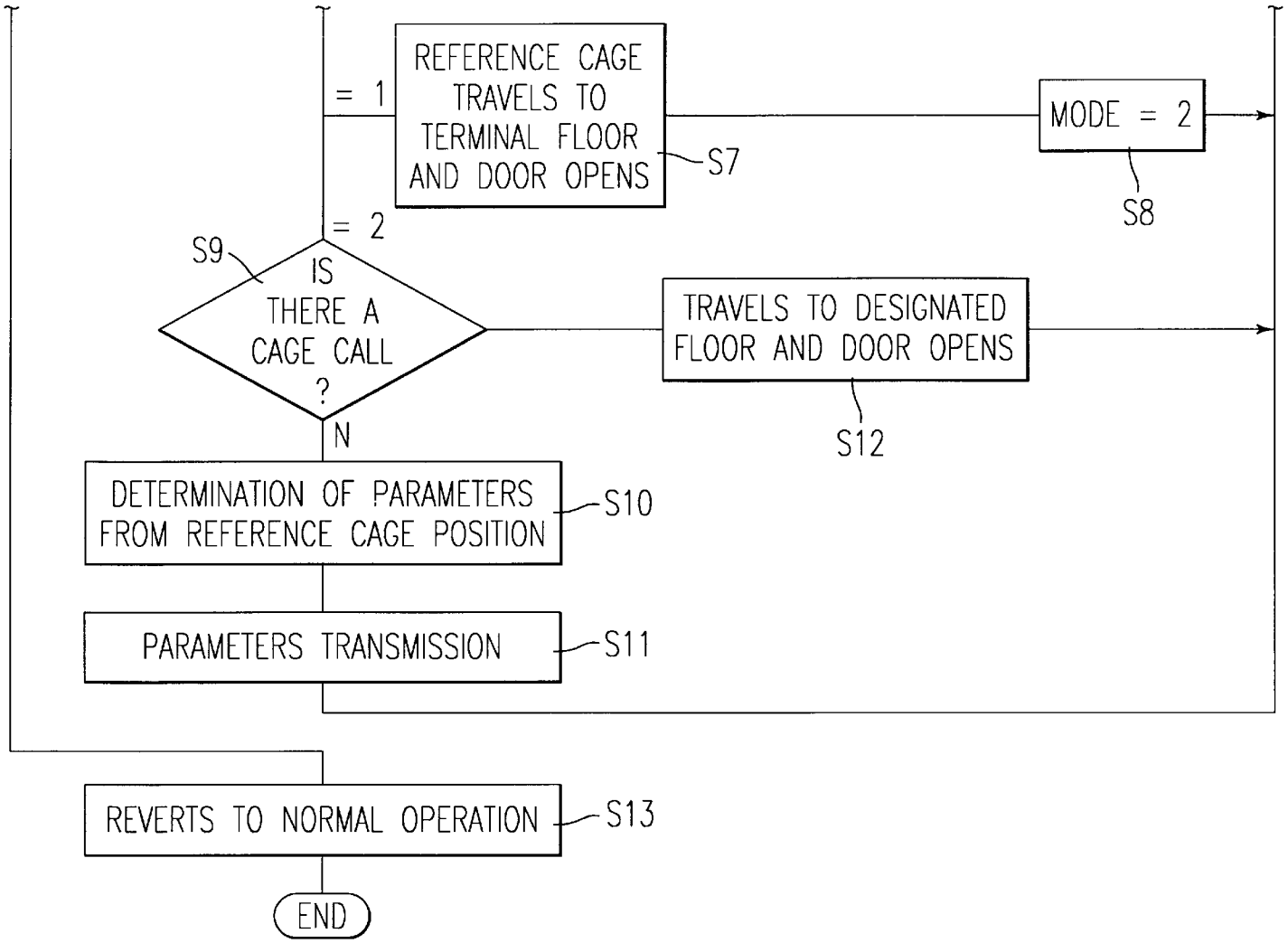

FIG. 5 is a flow-chart showing the operation of the hall controller parameter-setting device in the second embodiment. This adds Step S14 to Step S17 to the operation of the hall controller parameter-setting device in the first embodiment shown in FIG. 3. Since the other steps are identical, identical reference numerals designate those identical steps and their descriptions have been omitted.

First, the process is in mode "0" in the initial state (S1), and whether or not there is a request for termination of processing is judged (S2). In the case of there not being a request for termination of processing, whether or not there is a reference cage change request is judged (S14). When, by that judgement, there is judged not to be a reference cage change request, the same processing as for the operation of the hall device parameter-setting device in the first embodiment shown in FIG. 3 is performed. That is to say, processing from Step S3 onward is performed.

On the other hand, when it is judged by the judgement in Step S14 that there is a reference cage change request, the floor at which the current reference cage is positioned is made the terminal floor, and the terminal floor is re-set (S15). Then, the reference cage is changed to the other cage (S16), the mode is made "1", and the processing returns to Step S2 (S17). In this case, since the mode has become "1", processing from Step S7 onward is performed.

When the above is done, the reference cage after the change can also reach the floor which was unreachable by the reference cage prior to the change. Therefore, parameter-setting of the hall devices installed on all floors is completed. Also, when data indicating termination is inputted by the operator during these processes (for instance, if the door opening button inside the reference cage is continuously pressed for 1 second or more), the elevator reverts to normal operation (S13). When the above is done, parameter-setting of hall devices installed on all the floors can be efficiently performed.

Figure 6:
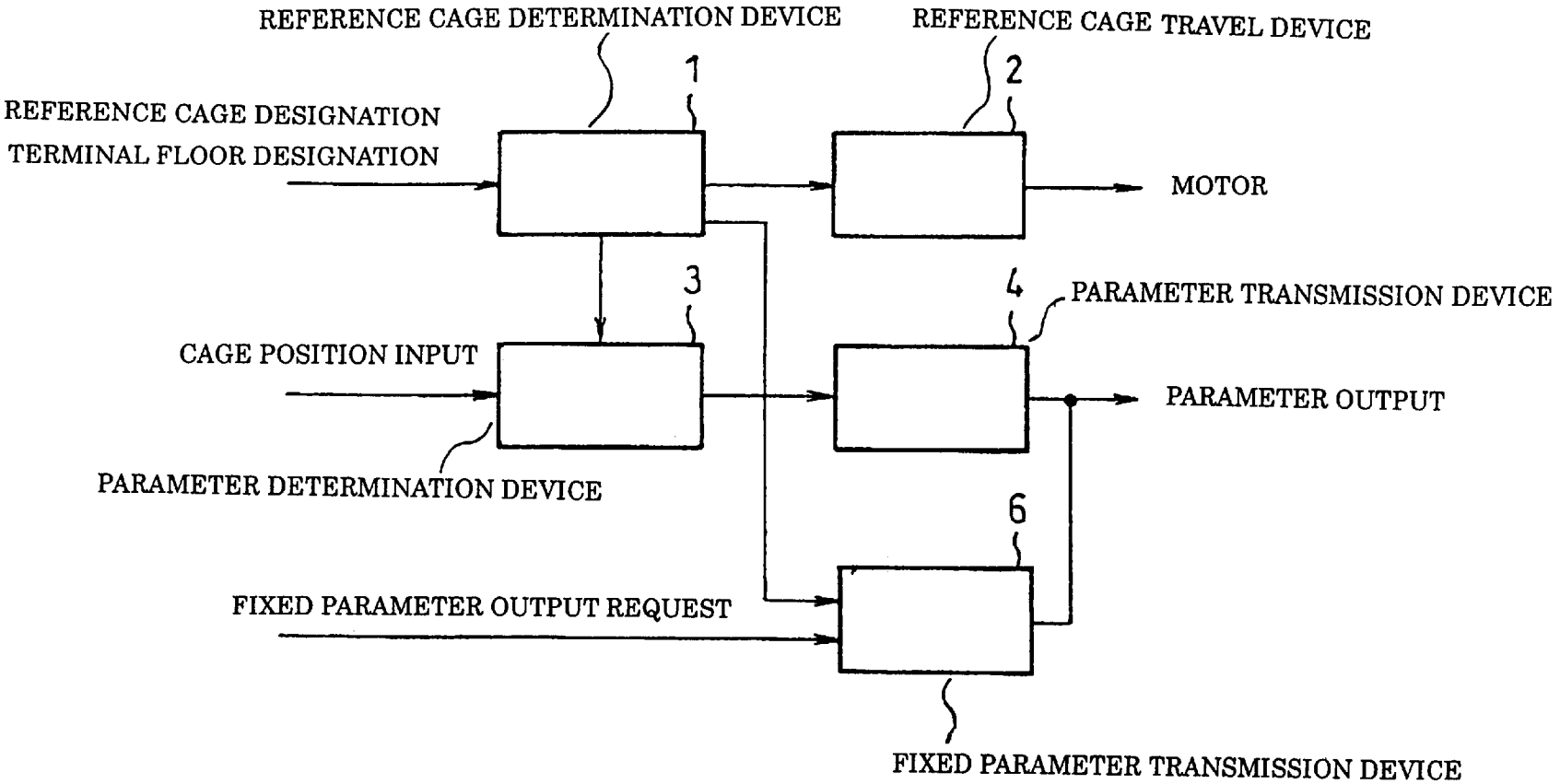
FIG. 6 is a block diagram of the hall controller parameter-setting device concerned in a third embodiment of the present invention.

Next, a third embodiment of the present invention is described. FIG. 6 is a block diagram showing the hall controller parameter-setting device concerned in the third embodiment of the present invention. This third embodiment additionally provides fixed parameter transmission device 6, for transmitting fixed parameters which have been pre-determined for hall devices installed on specific floors out of the various floors, to the first embodiment shown in FIG. 2. Since the rest of the composition is identical to that of the first embodiment shown in FIG. 2 and the same reference numerals designate identical parts, their descriptions have been omitted.

In FIG. 6, for performing parameter-setting of the hall device of a reference cage unreachable floor, the operator makes a fixed parameter output request. For example, he makes the fixed parameter output request by simultaneously pressing the door opening button and the door closing button inside the reference cage. When there is a fixed parameter output request, fixed parameter transmission device 6 transmits pre-determined fixed parameter values to the hall device. For example, the fixed parameter values correspond to highest floor or the lowest floor, and the values are made to correspond to the lowest floor when the reference cage is the upper cage and to the highest floor when the reference cage is the lower cage. The operator moves on foot to the floor corresponding to the fixed parameters, and operates the parameter reception trigger of the hall device on that floor (for example, the pressing of the hall call button). By this means, the parameter-setting of the hall installed on the lowest floor is completed.

Figure 7A:
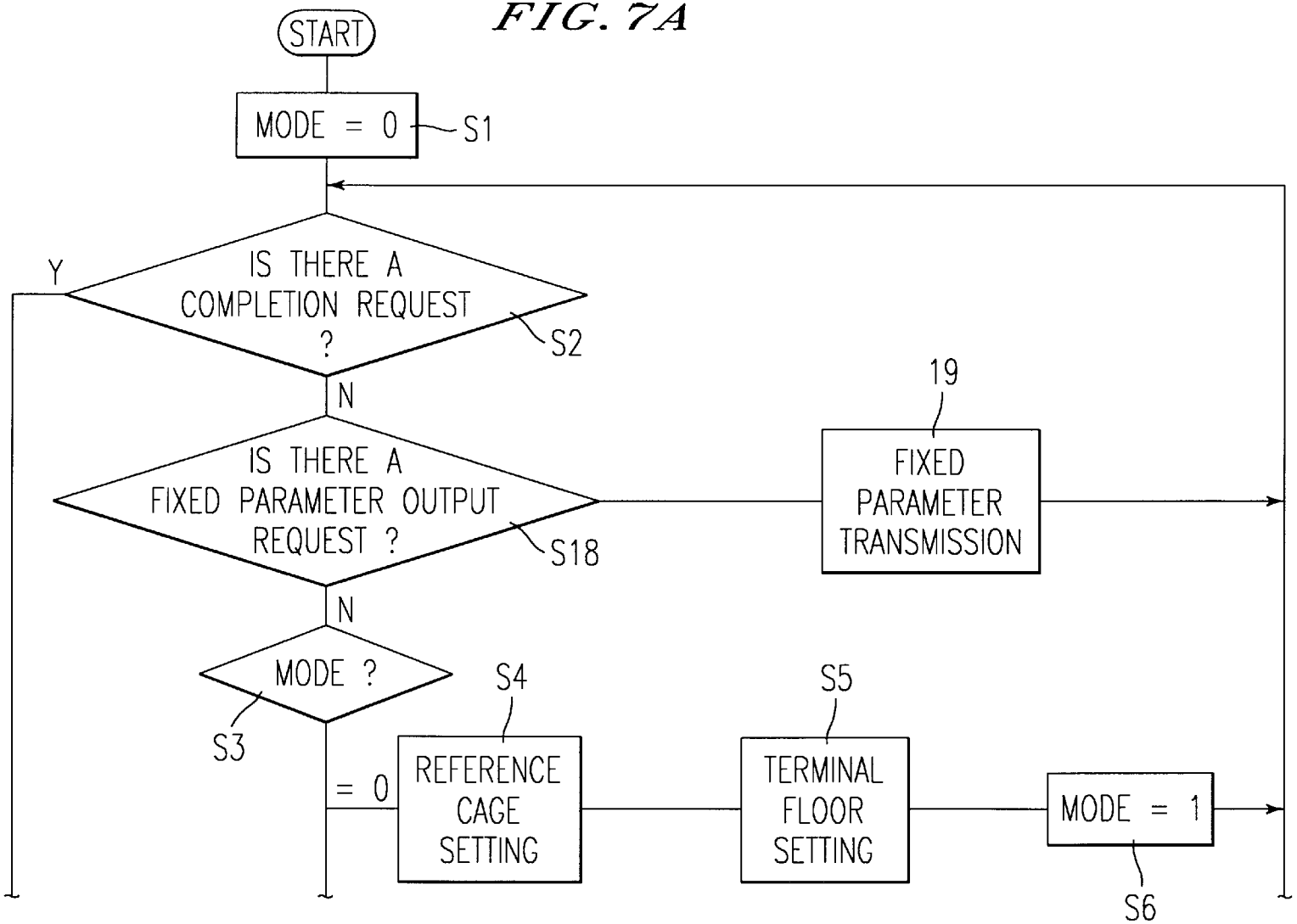
FIG. 7 is a flow-chart showing the operation of the hall controller parameter-setting device in the third embodiment.
Figure 7B:
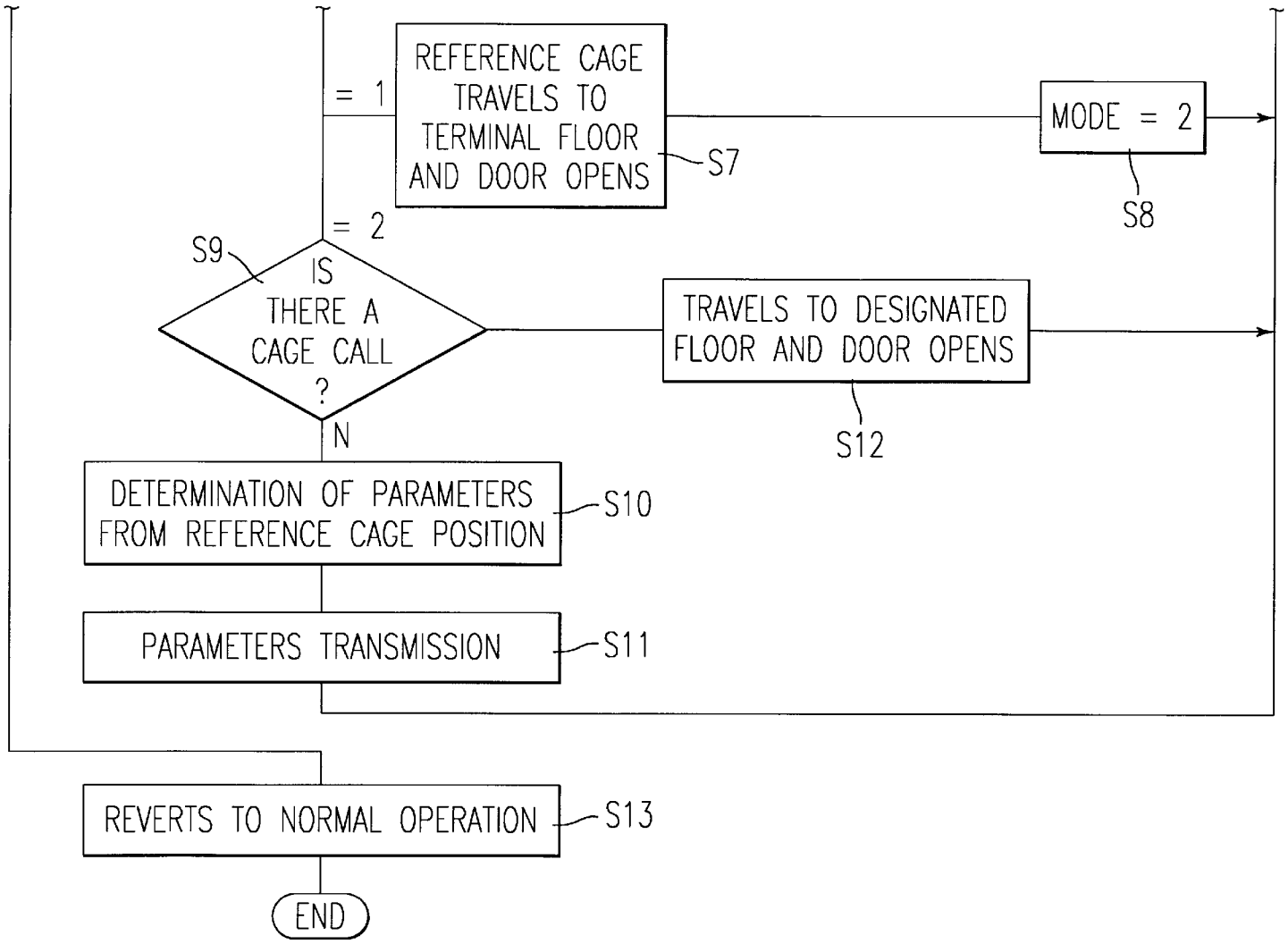

FIG. 7 is a flow-chart showing the operation of the hall controller parameter-setting device in the third embodiment. This adds Step S18 and Step S19 to the operation of the hall controller parameter-setting device in the first embodiment shown in FIG. 3. Since the other steps are identical, identical reference numerals designate those identical steps and their descriptions have been omitted.

First, the mode is "0" in the initial state (S1), and whether or not there is a processing termination request is judged (S2). In the case of there not being a processing termination request, whether or not there is a fixed parameter output request is judged (S18). When, by that judgement, there is judged not to be a fixed parameter output request, the same processing as for the operation of the hall controller parameter-setting device in the first embodiment shown in FIG. 3 is performed. That is to say, processing from Step S3 onward is performed.

On the other hand, when, by the judgement of Step S18, there is judged to be a fixed parameter output request, pre-determined fixed parameter values are transmitted to the hall device, and processing returns to Step S2 (S19). For example, the fixed parameter values are values which correspond to the highest floor or the lowest floor, and when the reference cage is the upper cage the values which correspond to the lowest floor are transmitted, but when the reference cage is the lower cage the values corresponding to the highest floor are transmitted. Then, processing from Step S3 onward is performed.

Also, when data indicating termination is inputted by the operator during these processes (for instance, if the door opening button inside the reference cage is continuously pressed for 1 second or more), the elevator reverts to normal operation (S13). When the above is done, parameter-setting of hall devices installed on all the floors can be efficiently performed.

Figure 8:
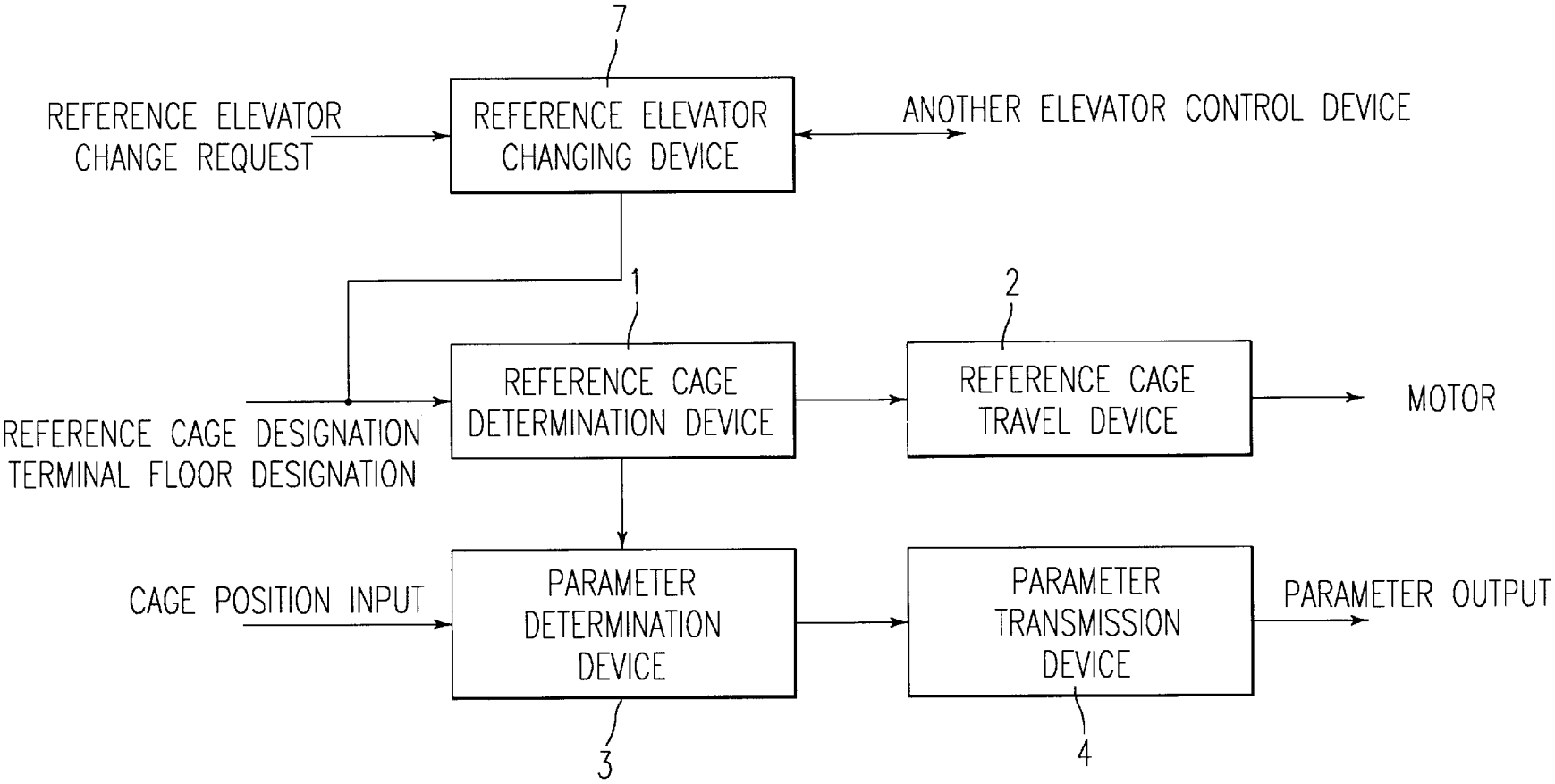
FIG. 8 is a block diagram of the hall controller parameter-setting device concerned in a fourth embodiment of the present invention and FIG. 9 is a flow-chart showing the operation of the hall controller parameter-setting device in the fourth embodiment.

Next, a fourth embodiment of the present invention is described. FIG. 8 is a block diagram showing the hall controller parameter-setting device concerned in the fourth embodiment of the present invention. This fourth embodiment additionally provides reference elevator changing device 7, which changes the reference cage to the cage of another double-deck elevator which mutually exchanges data, to the first embodiment shown in FIG. 2.

Since the rest of the composition is identical to that of the first embodiment shown in FIG. 2 and the same reference numerals designate identical parts, their descriptions have been omitted.

In FIG. 8, for performing parameter-setting of the hall device of a reference cage unreachable floor, the operator makes a reference elevator change request. For example, he makes the reference elevator change request by simultaneously pressing the door closing button and the door opening button inside the reference cage. When there is a reference elevator change request, reference elevator changing device 7 produces terminal floor designation data by making the cage position of the thereto reference cage on a new terminal floor and, at the same time, produces reference cage designation data by making the thereto reference cage a new reference cage. Then, it outputs these to reference cage determination device 1. Also it transmits the produced terminal floor designation data and reference cage designation data to the other elevator control device.

When the elevator control device which receives these data is that of a double-deck elevator, reference cage determination device 1 determines the reference cage based on the received reference cage designation data. For example, if the thereto reference cage is the upper cage it determines the lower cage, and if the thereto reference is the lower cage it determines the upper cage, as the next reference cage.

Figure 9A:
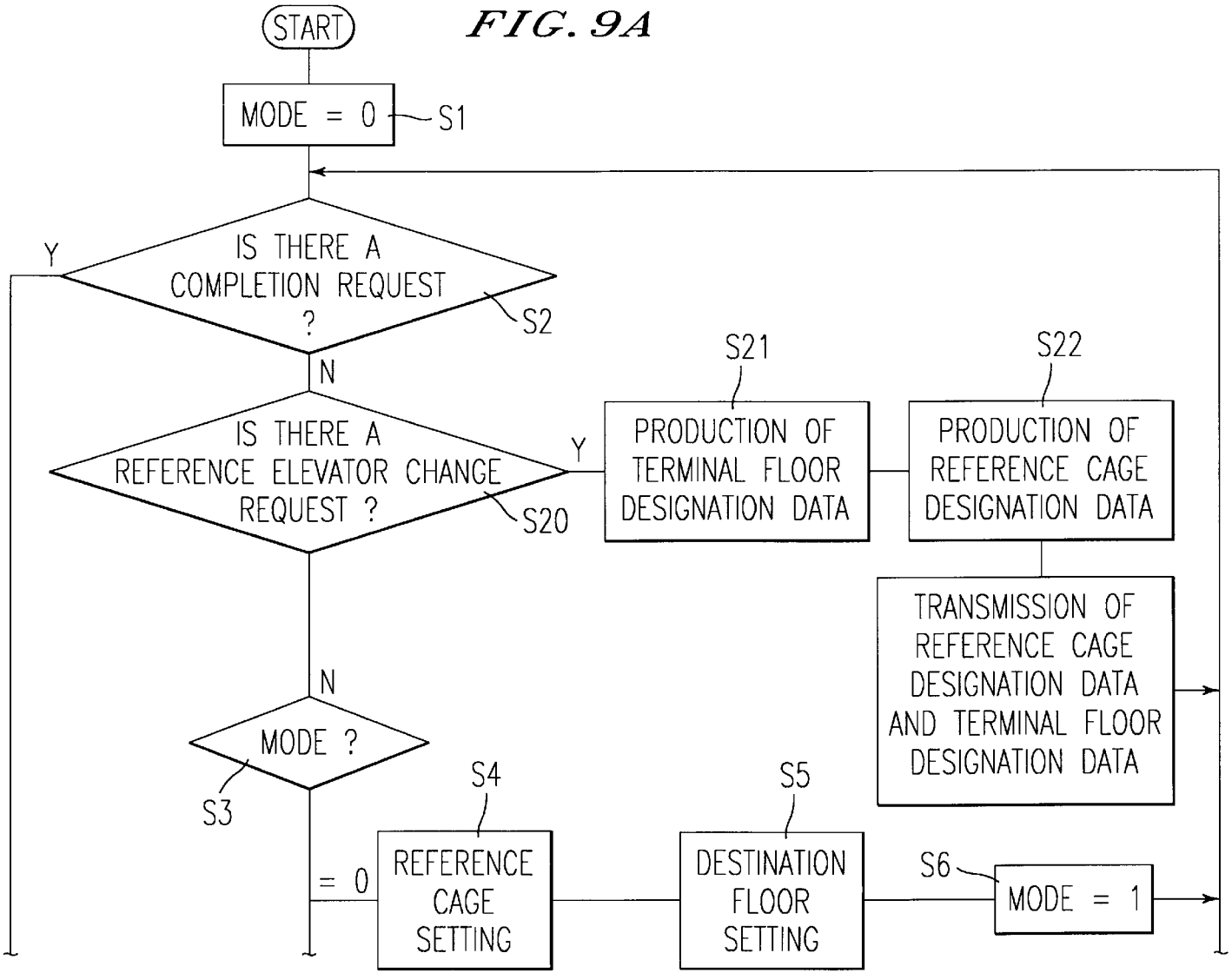
Figure 9B:
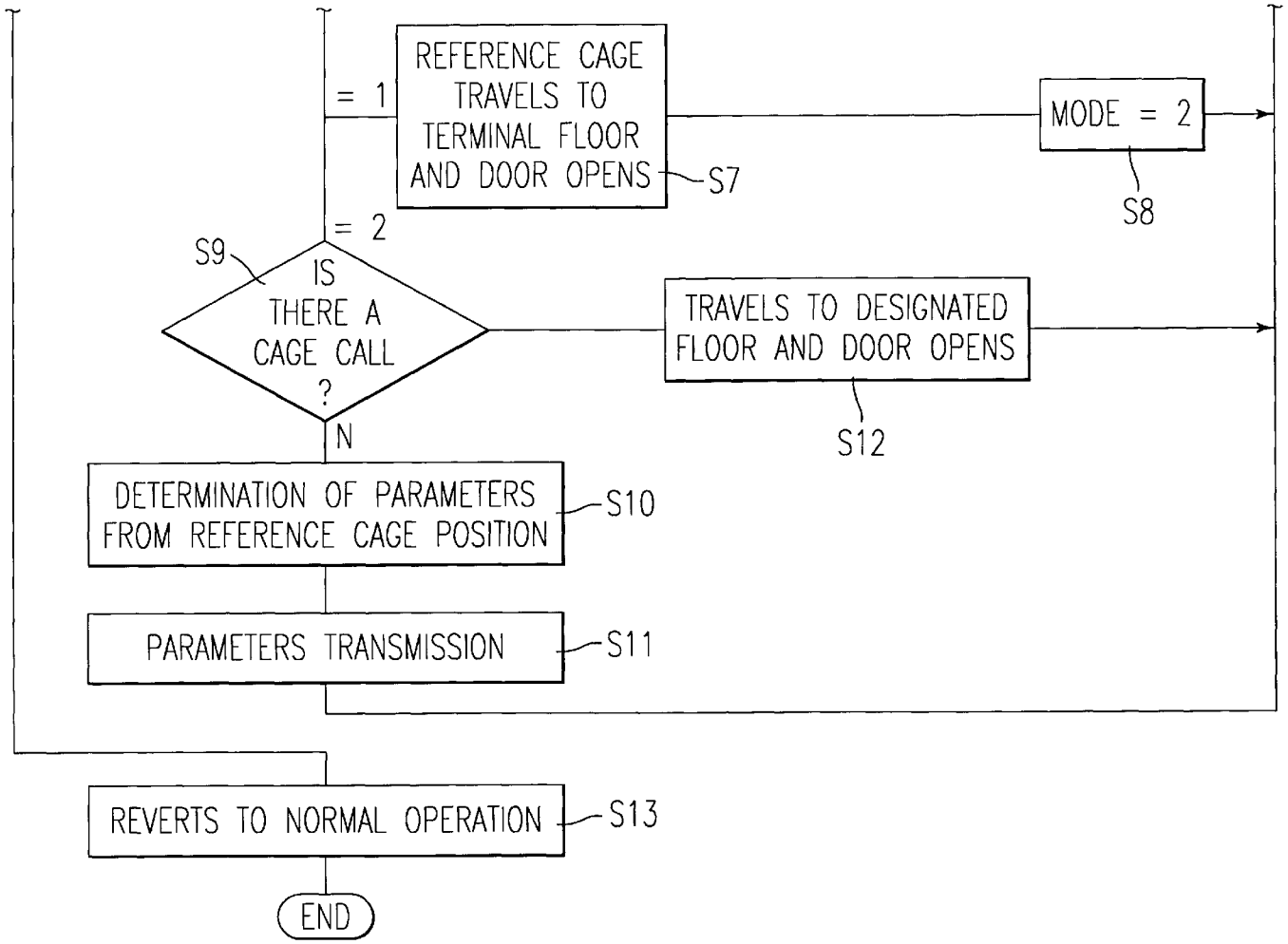

FIG. 9 is a flow-chart showing the operation of the hall controller parameter-setting device in the fourth embodiment. This adds Step S20 to Step S23 to the operation of the hall controller parameter-setting device in the first embodiment shown in FIG. 3. Since the other steps are identical, identical reference numerals designate those identical steps and their descriptions have been omitted.

First, the mode is "0" in the initial state (S1), and whether or not there is a processing termination request is judged (S2). In the case of there not being a processing termination request, whether or not there is a reference elevator change request is judged (S20). When, by that judgement, there is judged not to be reference elevator change request, the same processing as for the operation of the hall device parameter-setting device in the first embodiment shown in FIG. 3 is performed. That is to say, processing from Step S3 onward is performed.

On the other hand, when it is judged by Step S20 that there is a reference elevator change request, new terminal floor designation data is produced by making the cage position of the thereto reference cage a new terminal floor (S21). Also, reference cage designation data is produced by making the thereto reference cage a new reference cage (S22). Next, the terminal floor designation data and the reference cage designation produced in Step S21 and Step S22 are transmitted to another elevator control device and processing returns to Step S2 (S23).

Then, in the case of the elevator control device which receives the data from Step S23 being that of a double-deck elevator, the reference cage is decided in Step S4 based on the received reference cage designation data. For example, if the thereto reference cage is the upper cage it determines the lower cage, and if the thereto reference is the lower cage it determines the upper cage, as the next reference cage.

Next, by performing Step S7, the newly determined reference cage travels to the floor on which the operator is, and the door is opened. Then, the operator makes a cage call to the floor which was unreachable by the previous reference cage (for example, the lowest floor). By re-executing Step S10 to Step S12 by so doing, parameter-setting of the hall devices on all floors is completed. Also, when data indicating termination is inputted by the operator during these processes (for instance, if the door floor button inside the reference cage is continuously pressed for 1 second or more), the elevator reverts to normal operaton (S13).

On the other hand, in the case of the elevator control device which receives the data in Step S23 being that of a single-deck elevator, determination of the reference cage in Step S4 becomes unnecessary. In this case, the processing in Step S5 onward may be performed. When the above is done, parameter-setting of hall devices installed on all floors can be efficiently performed.

As described above, when using the present invention, parameter-setting of hall devices installed on unreachable floors can be efficiently performed.

Also, when using the present invention, since the operator can select which of the upper and lower cages to make the reference cage, the hall device parameter-setting operation work can be readily performed.

Moreover, when using the present invention, since the reference cage can be changed from one to the other part-way through the operation, the hall device parameter-setting work can be readily performed.

Furthermore, when using the present invention, since parameters are outputted in fixed form for the hall devices of reference cage unreachable floors, the efficiency of the setting work can be improved.

Yet further, when using the present invention, in the case of operating by two or more elevators mutually exchanging data, since the setting of unreachable floors can be performed by transferring to another elevator cage, the efficiency of the setting work can be improved.

Obviously, numerous additional modifications and variations of the present invention are possible in light of the above teachings. It is therefore to be understood that within the scope of the appended claims, the invention may be practiced otherwise than as specially described herein.

What is claimed as new and desired to be secured by Letters Patent of the United States is:

1. A hall controller parameter-setting device for setting parameters in hall devices installed at halls on every floor of a double-deck elevator having a construction in which two cages are connected vertically, said hall controller parameter-setting device comprising:

a reference cage determination device for determining as a reference cage a cage which is designated out of upper and lower cages when said reference cage is designated at the time of determining said parameters which distinguish said hall devices;

a reference cage travel device for raising/lowering said reference cage determined by said reference cage determination device to and stops it at a designated terminal floor;

a parameter determination device for determining said parameters based on a floor at which said reference cage determined by said reference cage determination device has stopped; and a parameter transmission device for transmitting said parameters determined by said parameter determination device to one of said hall devices of a floor at which said reference cage is positioned.

2. The hall controller parameter-setting device according to claim 1, further comprising:

a reference cage changing device for changing said reference cage to an other cage out of said upper and lower cages.

3. The hall controller parameter-setting device according to claim 1, further comprising:

a fixed parameter transmission device for transmitting pre-determined parameters to said hall devices installed on specific floors out of said every floor.

4. The hall controller parameter-setting device according to claim 1, further comprising:

a reference elevator changing device for changing said reference cage to a cage of another double-deck elevator which performs mutual exchange of data.

5. The hall device parameter-setting device according to claim 1, wherein each one of said parameters comprises a device address of at least one of said hall devices.

6. The hall device parameter-setting device according to claim 2, wherein said reference cage changing device further comprises:

a reference cage changing device for changing said reference cage to an other cage out of said upper and lower cages for reference cage unreachable floors out of said every floor.

* * * * *